US006531088B2

(12) United States Patent
Bortoloni

(10) Patent No.: US 6,531,088 B2
(45) Date of Patent: Mar. 11, 2003

(54) AUTOMATIC DOOR FOR MOLTEN METAL HOLDING FURNACE

(75) Inventor: Andrea Bortoloni, Noventa Padovana (IT)

(73) Assignee: Borli Engineering S.p.A., Padovana (IT)

( * ) Notice: Subject to any disclaimer, the term of this patent is extended or adjusted under 35 U.S.C. 154(b) by 0 days.

(21) Appl. No.: 09/848,260

(22) Filed: May 4, 2001

(65) Prior Publication Data

US 2001/0048187 A1 Dec. 6, 2001

(30) Foreign Application Priority Data

May 31, 2000 (IT) ..... PD00A0146

(51) Int. Cl.[7] ..... F27D 1/18
(52) U.S. Cl. ..... 266/280; 266/287; 432/250
(58) Field of Search ..... 266/242, 287, 266/252, 280; 432/250

(56) References Cited

U.S. PATENT DOCUMENTS 2,105,873 A * 1/1938 Weinheimer ..... 432/250
2,254,900 A * 9/1941 Lessmann ..... 432/250
2,262,363 A * 11/1941 Hoop ..... 432/250
6,000,938 A * 12/1999 Melanowicz ..... 432/250
2001/0048187 A1 * 12/2001 Botoloni ..... 266/242

* cited by examiner

*Primary Examiner*—Scott Kastler
(74) *Attorney, Agent, or Firm*—Dowell & Dowell, P.C.

(57) ABSTRACT

A door for molten metal holding furnaces which includes a fixed plate with charging and inspection hole provided with two supports positioned at the sides of the charging hole and with two vertical wings positioned on an upper part of the plate and two guides are hinged to the two vertical wings and directed downwards, beyond a lower edge of the charging hole. A closing panel with gasket is equipped with lateral pins that are housed in the guides for making the closing panel slide along the guides. One or more pressure mechanisms act on lower ends of the guides and rotate the guides so as to bring the closing panel in contact with the plate and press the panel against the hole or to move it away from the plate.

7 Claims, 4 Drawing Sheets

AUTOMATIC DOOR FOR MOLTEN METAL HOLDING FURNACE

BACKGROUND OF THE INVENTION

1. Field of the Invention

The present invention concerns plants for the production of metal articles through the feeding of molten metal under pressure from a holding furnace to a die positioned on a surface of a press located on the furnace.

2. Description of the Related Art

At present many metal articles, for example the rims of vehicle wheels, are produced through the forced injection of molten metal into a die. Molten metal is usually kept in holding furnaces. A hydraulic press is positioned on top of the holding furnace and, on a lower plane of the press, a die is provided which communicates with the bottom of the holding furnace through a vertical duct. The furnace is pressurized with compressed air so that the molten metal is conveyed upward along the duct until reaching the die and filling it.

Molten metal is periodically introduced into the holding furnace through an appropriate opening provided with a door. Since the furnace is pressurized with compressed air, the door must ensure a perfect seal. For this purpose, the door is provided with a gasket made of a suitable heat-resistant material, which, however, wears out due to repeated use and must be periodically replaced.

At present, the doors of holding furnaces comprise a simple panel hinged to the furnace, which is lifted either for the introduction of new molten metal into furnace itself or for the replacement of the gasket. These doors present a series of drawbacks, since the opening and closing mechanism exerts an asymmetrical pressure on the gasket and does not ensure a perfect seal, thus making it necessary to change the gasket frequently. Furthermore, due to such opening and closing systems, maintenance operations on the door and/or on the charging hole and/or the gasket are neither quick, nor simple to carry out.

SUMMARY OF THE INVENTION

The subject of the present invention is a new automatic door for molten metal holding furnaces which is provided with a double opening/closing and tilting mechanism for the replacement of the gaskets and/or the maintenance of the door and the charging hole. The new door for holding furnaces simplifies the opening and closing operations, ensures easy and precise maintenance of the door and/or the charging hole and also allows the gasket of the door to be easily changed, and furthermore no special external equipment is required to open, close or tilt the door.

The new automatic door comprises a fixed plate with charging and inspection hole integral with the furnace itself, a moveable closing panel with replacement gasket, two rotary guides, two parallel lever systems that press the closing panel against the furnace mouth, two adjusting mechanisms, a hydraulic cylinder that provides for the sliding movement of the closing panel and two hydraulic cylinders operating the lever systems that press the closing panel.

BRIEF DESCRIPTION OF THE DRAWINGS

The following is just an example, among many, of a practical embodiment of the new automatic door, whose description refers to the attached drawings, wherein.

DESCRIPTION OF THE PREFERRED EMBODIMENT

Figure 1:
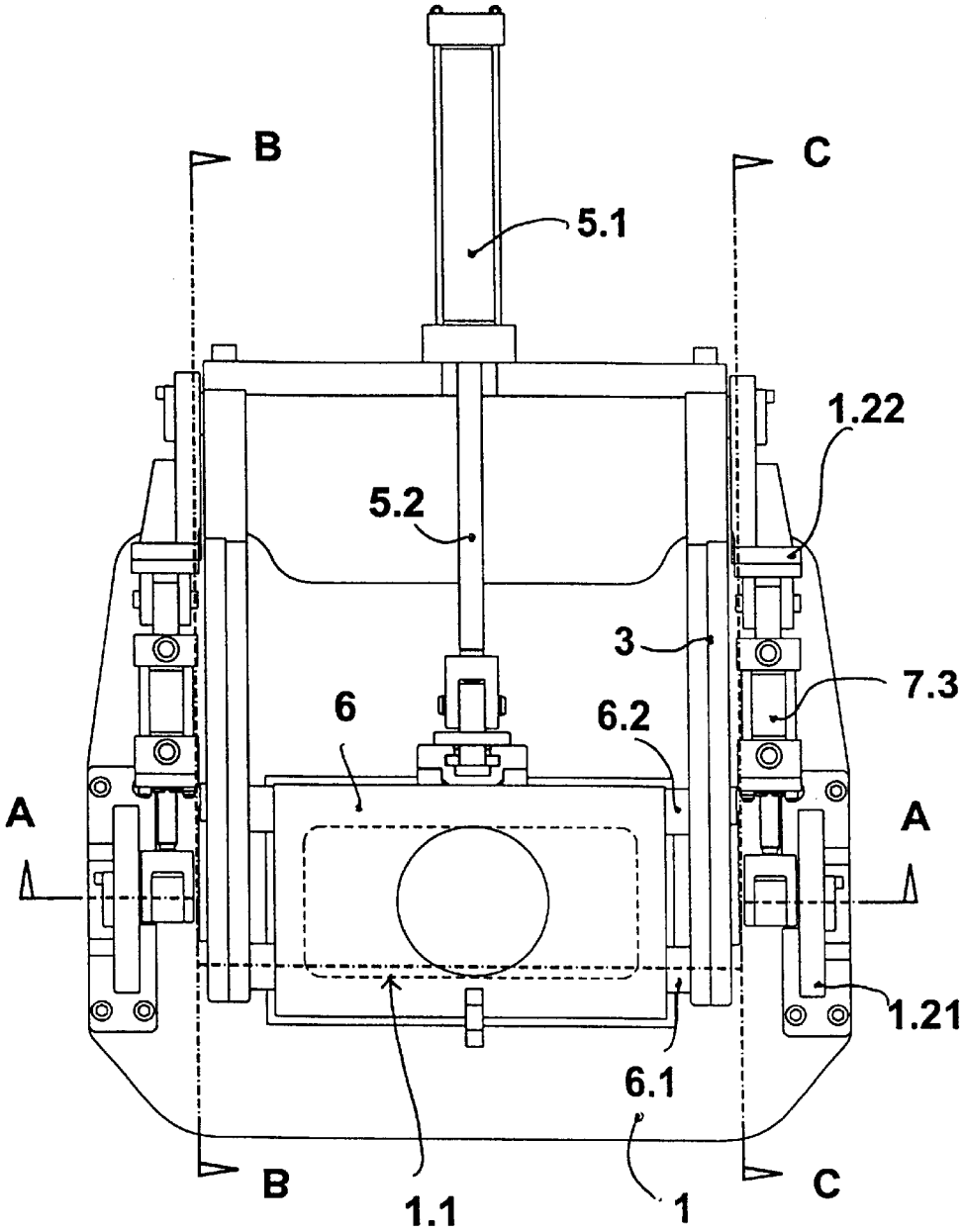
FIG. 1 is a front view of the new door.
Figure 2:
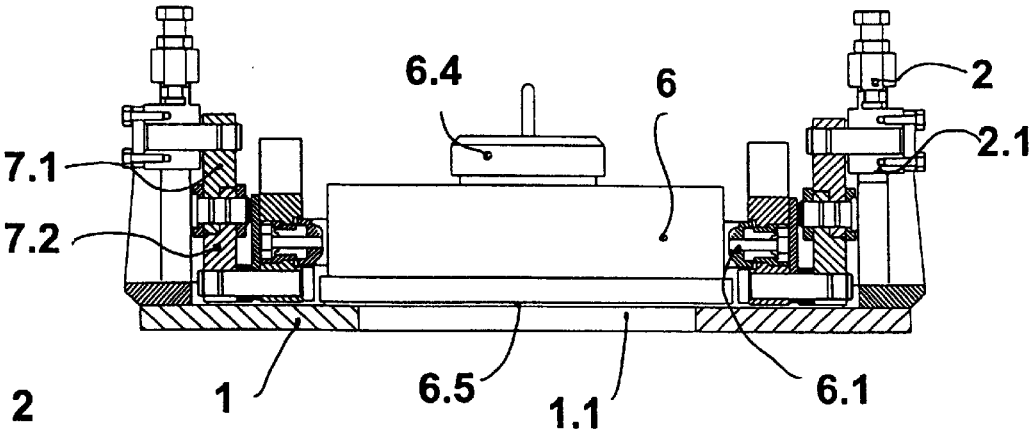
FIG. 2 is a horizontal section along line A—A.
Figure 4:
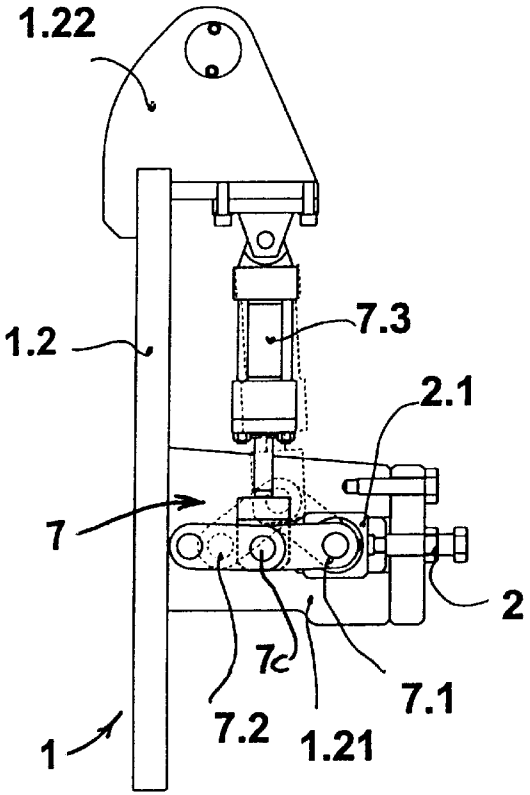
FIG. 4 is a vertical section along line C—C.
Figure 3:
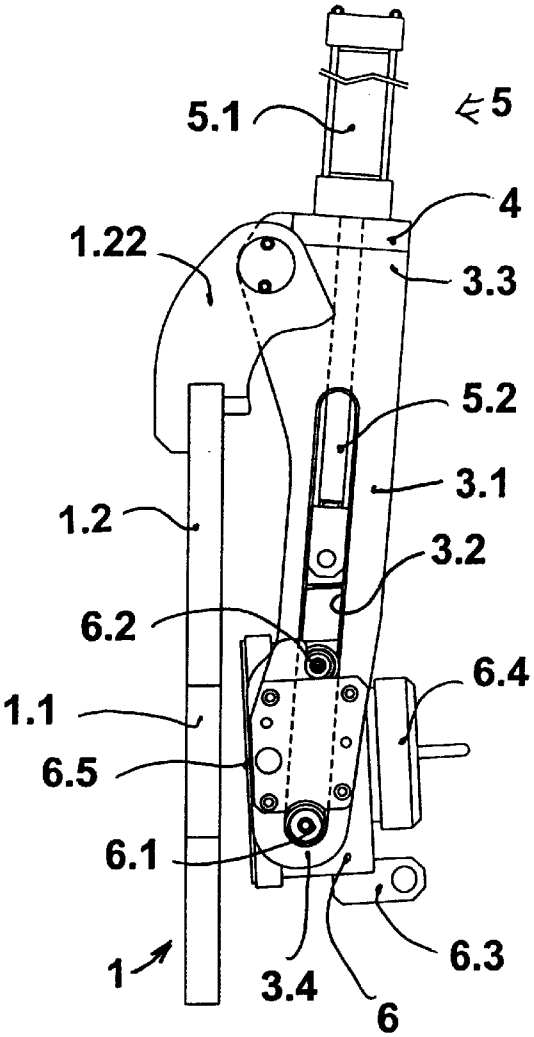
FIG. 3 is a vertical section along line B—B.

A plate (1) with a charging hole (1.1) and structure (1.2) constitutes the mouth of the furnace. The hole (1.1) provided on the plate makes it possible to reach and/or inspect the inside of the furnace. The structure (1.2) of the plate (1) serves as support for the other components of the automatic door and in particular it mounts two supports (1.21) positioned at the sides of the charging hole (1.1) and two vertical wings (1.22) positioned on the upper part of the plate (1). Each one of the two supports (1.21) positioned at the sides of the charging hole (1.1) is provided with one of the two adjusting mechanisms (2) that substantially comprise a drilled sliding element (2.1) that slides to approach and move away from the plate (1) and can be locked as desired at intermediate distances from the plate (1).

Each one of two rotary guides (3) is constituted by a generically rectangular plate (3.1) provided with an elongated slot (3.2) which is parallel to the substantially vertical side of the plate (3.1). Each guide (3) has its upper end (3.3) hinged or pivotally mounted to a vertical wing (1.22) of the plate (1) and is longer than the distance between the wings (1.22) and the lower edge of the charging hole (1.1) of the plate (1). The upper ends (3.3) of the two guides (3) are joined by a cross element (4) that serves as a mounting base for a hydraulic cylinder (5) that ensures the sliding movement of a closing panel (6).

The lower ends (3.4) of the two guides (3) are connected to the two lateral supports (1.21) of the plate (1) by means of a pressure lever systems (7). Each pressure lever system (7) comprises two connecting rods (7.1, 7.2) hinged to each other. One of the connecting rods (7.1), which is further from the plate (1), is hinged to the adjusting mechanism (2) described above, while the other connecting rod (7.2), which is nearer to the plate (1), is hinged to the lower end (3.4) of the adjacent rotary guide (3).

The two hydraulic cylinders (7.3) that press the door against the hole (1) are connected to the upper vertical wings (1.22) of the plate (1) and to a common hinge point **(7*c*) between the two connecting rods (7.1, 7.2) of the pressure lever system (7)**.

Each retraction of the two hydraulic cylinders (7.3) causes a rotating movement of the two connecting rods (7.1, 7.2) that form an acute angle, moving the lower end (3.4) of the rotary guides (3) away from the plate (1). Each extension of the two hydraulic cylinders (7.3) causes a rotating movement of the two connecting rods (7.1, 7.2) that form an obtuse or straight angle, reducing the distance between the lower end (3.4) of the rotary guides (3) and the plate (1).

The closing panel (6) that constitutes the actual opening and closing door comprises a panel made of a suitable material with appropriate thickness, provided on opposite sides with four pins (6.1, 6.2), two for the right side and two for the left side, which slide in the elongated slots (3.2) of the rotary guides (3). The two upper pins (6.2) are fixed, while the two lower pins (6.1) can be removed from the closing panel (6).

The surface of the closing panel (6) that faces the plate (1) is equipped with an appropriate gasket (6.5). A coupling point, a ring or a drilled plate (6.3) is provided near the lower edge of the closing panel (6). The closing panel (6) can be provided with a hole with a plug (6.4), in such a way as to permit a visual check of the inside of the furnace, with no need to open it.

The hydraulic cylinder (5) is mounted to the cross element (4) that joins the upper ends (3.3) of the rotary guides (3) and is parallel to the rotary guides (3). In particular, the body (5.1) of the cylinder (5) is positioned on the side of the cross element (4) that is opposite the rotary guides (3), while the sliding rod (5.2) of the cylinder (5) is positioned between the rotary guides (3), connected to the upper edge of the closing panel (6). The connection between the sliding rod (5.2) of the cylinder (5) and the closing panel (6) is such as to ensure a rapid release of the cylinder (5) from the closing panel (6), with a perpendicular movement with respect to the plane of the closing panel (6).

The movement of the rod (5.2) of the hydraulic cylinder (5) causes the translation of the closing panel (6) from a lower position in which it covers the hole (1.1) of the plate (1) completely to a higher position in which it leaves the hole (1.1) of the plate (1) completely open.

All the hydraulic cylinders (7.3, 5) of the new automatic door are controlled by appropriate solenoid valves that properly convey a flow of pressurized fluid coming from an appropriate pump. An electronic/electromechanical unit controls the operation of the solenoid valves, the pump and the various operating and safety sensors during the opening, closing and servicing of the new automatic door.

When the door must be opened, the cylinders (7.3) are retracted, so that the lower ends (3.4) of the rotary guides (3) move away from the plate (1) and, successively, the cylinder (5) is also retracted to move the closing panel (6) upwards and permit free access to the hole (1.1) of the plate (1) that constitutes the access to the furnace.

When the door must be closed, the cylinder (5) is extended to move the closing panel (6) downwards until it is positioned before the hole (1.1) of the plate (1) and, successively, the cylinders (7.3) are extended, so that the lower ends (3.4) of the rotary guides (3) approach the plate (1), pressing the closing panel (6) and the relevant gasket (6.5) against the hole (1.1) of the plate (1) and thus closing the furnace.

Due to the successive pressures exerted by the closing panel (6) against the hole (1.1) of the plate (1), the thickness of the gasket (6.5) of the closing panel (6) is gradually reduced and it becomes necessary to act on the adjusting mechanisms (2) positioned on the lateral supports (1.21) of the plate (1).

Figure 5:
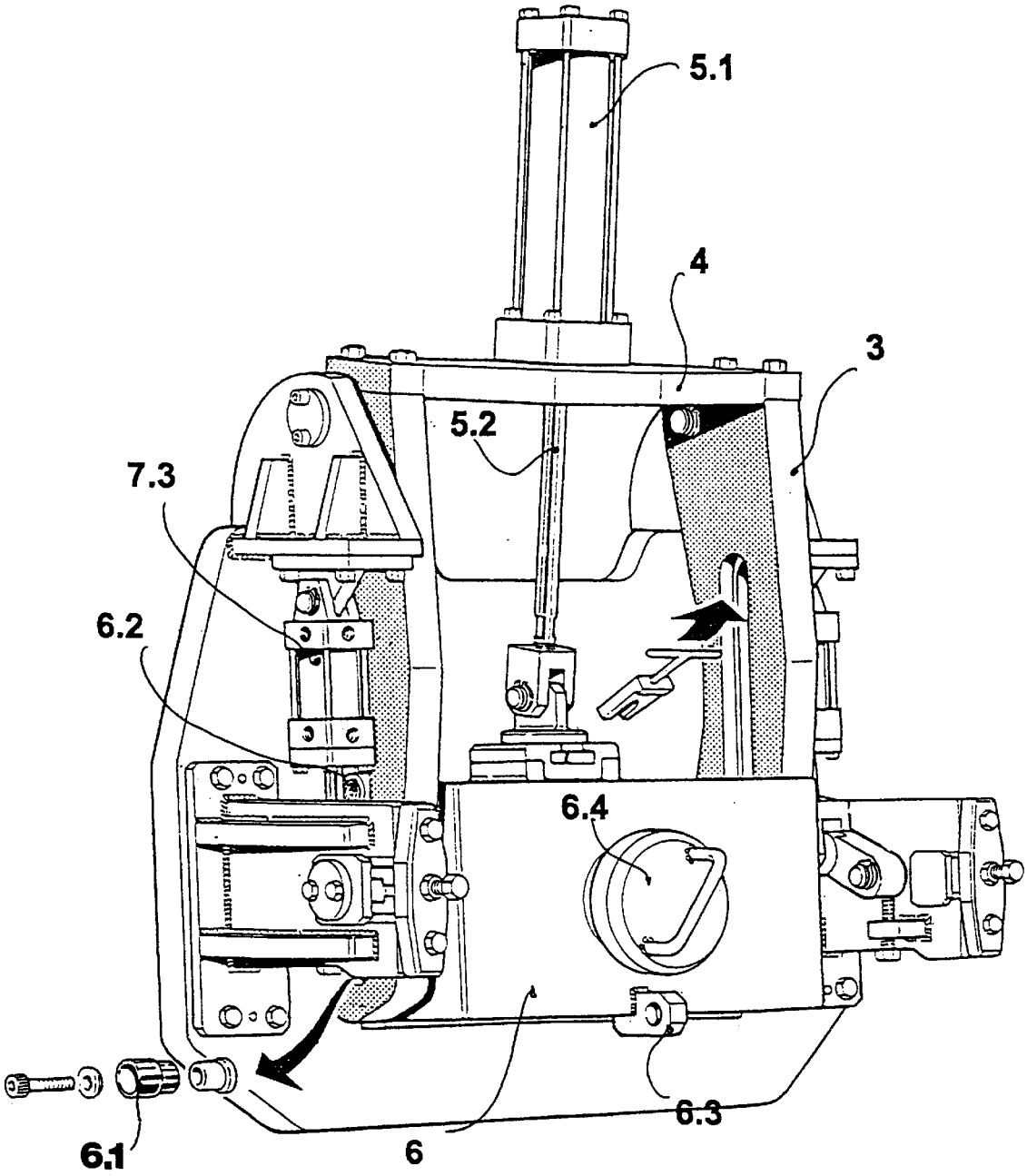
FIGS. 5 and 6 show further views of the new door.

When it is necessary to carry out maintenance operations on the closing panel (6), for example to replace the gasket (6.5) when it is worn, the closing panel (6) is moved away from the hole (1.1) of the plate (1) by retracting the cylinders (7.3). The rod (5.2) of the cylinder (5) is released from the closing panel (6) and the lower pins (6.1) of the closing panel (6) are removed (FIG. 5).

Figure 6:
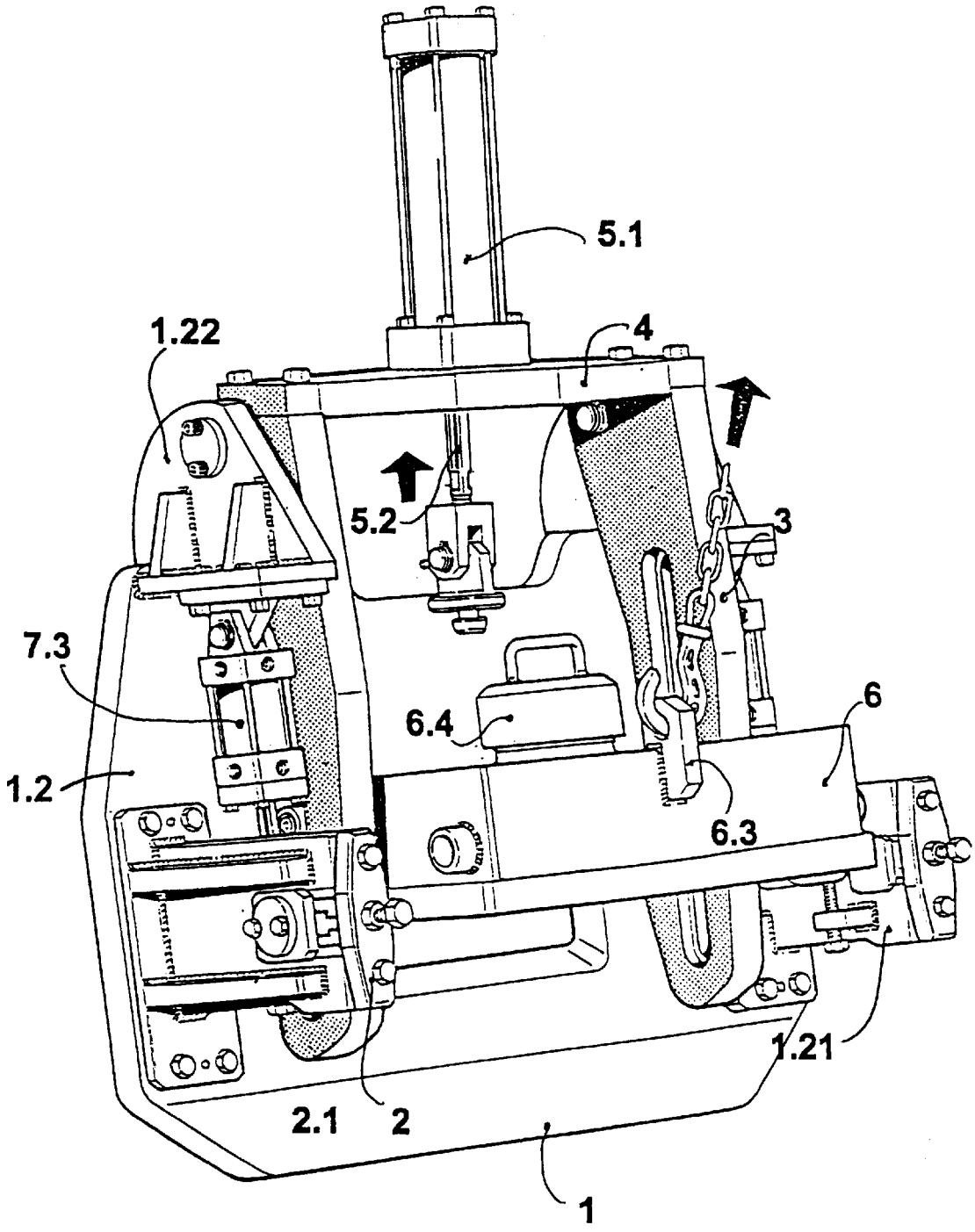

Successively, a winch or bridge crane is coupled to the coupling point, ring or drilled plate (6.3) provided near the lower edge of the closing panel (6) and the winch or bridge crane is operated, rotating the closing panel (6) completely, in such a way as to make its inner surface, which is generally pressed against the charging hole (1.1), fully visible (FIG. 6). To prevent the heat still present in the furnace from being dispersed and/or any object from falling inside the furnace, it is advisable to position a temporary wall or door on the charging hole of the furnace.

In order to prevent the fluid circulating in the hydraulic cylinder (5) and in the cylinders (7.3) from overheating due to the high temperature present immediately outside the furnace, the hydraulic circuits that operate the cylinder (5) and cylinders (7.3) are provided with double connections for the recirculation of the operating fluid, which is kept under pressure and conveyed in such a way as to make it pass through a suitable cooler. In this way, by keeping the fluid temperature within the prescribed limits, it is possible to avoid the boiling of the fluid and any pressure variation of the same, which would make the operation of the cylinder (5) and cylinders (7.3) imprecise or even impossible.

The description is sufficient to enable one skilled in the art to realize the invention, consequently, in the final application, variations may be made without prejudicing the substance of the innovative concept. Therefore, with reference to the above description and the enclosed drawings, the following claims are put forth.

What is claimed is:

1. A door for a molten metal holding furnace, the door including a fixed plate with a charging hole, two supports positioned on opposite sides of the charging hole and two vertical wings positioned on an upper part of the plate, two guides, each having an elongated slots therein, are pivotally mounted to the two vertical wings positioned on the upper part of the fixed plate and each extending therefrom beyond a lower edge of the charging hole, and a closing panel with gasket for sealing about the charging hole being slideably mounted within the elongated slots of the guides, and closure operating means for moving the closing panel along the elongated slots of the two guides between a first position spaced from the fixed plate so that the charging hole therein is open and a second position in which the closing panel is urged toward the fixed panel and into proximity with the changing hole.

2. The door for a molten metal holding furnace according to claim 1, wherein the closure operating means includes at least one pressure applying mechanism which is connected to act on the lower end of the guides to move said guides in such a way as to urge the closing panel from the second position and press the closing panel against the fixed plate in sealing relationship with the charging hole.

3. The door for a molten metal holding furnace according to claim 2, wherein the at least one pressure applying mechanism includes two connecting rods pivotally connected to each other at a common point, wherein one of the connecting rods is hinged to one of two supports positioned on the fixed plate adjacent the charging hole and the other connecting rod, which is closer to the fixed plate is pivotally connected to the lower end of an adjacent guide, and wherein a hydraulic cylinder is connected to the vertical wings and to the common point between the two connecting rods so that a retraction of a piston rod of the hydraulic cylinder causes a rotating movement of the two connecting rods so that they extend at an acute angle relative to one another, thereby moving the lower end of the guides away from the fixed plate and wherein an extension of the piston rod causes a rotating movement of the two connecting rods so that they extend at an obtuse or straight angle relative to one another, thereby reducing a distance between the lower end of the guides and the fixed plate.

4. The door for a molten metal holding furnace according to claim 3, including a hydraulic cylinder that controls movement of the closing panel along the elongated slots of the guides.

5. The door for a molten furnace according to claim 4 wherein each of the hydraulic cylinders is provided with fluid connections wherein fluid that operates the cylinders is maintained under pressure and in constant recirculation with a heat exchanger.

6. The door for a molten metal holding furnace according to claim 2, including a hydraulic cylinder that controls movement of the closing panel along the elongated slots of the guides.

7. The door for a molten metal holding furnace according to claim 1, including a hydraulic cylinder that controls movement of the closing panel along the elongated slots of the guides.

* * * * *